US008993910B2

(12) United States Patent
Koherr et al.

(10) Patent No.: US 8,993,910 B2
(45) Date of Patent: Mar. 31, 2015

(54) GROUP OF MOMENTARY-CONTACT SWITCHES AS CONTROL PANEL WHICH CAN BE ILLUMINATED IN MOTOR VEHICLES

(75) Inventors: Joachim Koherr, Orsingen (DE); Harald Koehnlein, Hilzingen (DE)

(73) Assignee: TRW Automotive Electronics & Components GmbH, Radolfzell (DE)

( * ) Notice: Subject to any disclaimer, the term of this patent is extended or adjusted under 35 U.S.C. 154(b) by 388 days.

(21) Appl. No.: 13/382,307

(22) PCT Filed: Jul. 12, 2010

(86) PCT No.: PCT/EP2010/004237

§ 371 (c)(1),
(2), (4) Date: Mar. 20, 2012

(87) PCT Pub. No.: WO2011/015272

PCT Pub. Date: Feb. 10, 2011

(65) Prior Publication Data

US 2012/0186962 A1 Jul. 26, 2012

(30) Foreign Application Priority Data

Aug. 5, 2009 (DE) ..... 10 2009 036 209

(51) Int. Cl.
*H01H 13/14* (2006.01)
*H01H 13/83* (2006.01)

(52) U.S. Cl.
CPC ..... *H01H 13/83* (2013.01); *H01H 2219/028* (2013.01); *H01H 2219/044* (2013.01); *H01H2219/056* (2013.01); *H01H 2219/062* (2013.01); *H01H 2221/07* (2013.01); *H01H 2223/002* (2013.01); *H01H 2231/026* (2013.01)
USPC ..... 200/310; 200/314

(58) Field of Classification Search
CPC ..... H01H 13/23; H01H 13/14
USPC ..... 200/310, 314
See application file for complete search history.

(56) References Cited

U.S. PATENT DOCUMENTS

| | | | |
|---|---|---|---|
| 4,376,879 | A | 3/1983 | Nagata et al. |
| 2009/0173605 | A1 | 7/2009 | Liu et al. |

(Continued)

FOREIGN PATENT DOCUMENTS

| | | |
|---|---|---|
| CN | 201146131 | 11/2008 |
| DE | 3407937 | 9/1985 |
| DE | 4139554 | 4/1993 |

(Continued)

*Primary Examiner* — Renee S Luebke
*Assistant Examiner* — Ahmed Saeed
(74) *Attorney, Agent, or Firm* — Tarolli, Sundheim, Covell & Tummino LLP

(57) ABSTRACT

A pushbutton switch array is proposed which provides an illuminatable operating surface and manages with only few light sources without requiring any separate optical waveguide structures. The pushbutton switch array has a frame which is covered by a transparent film and includes recesses which have actuating elements accommodated therein for displacement. The actuating elements are configured to have light-guiding and light-coupling structures. A shared light source is, or only few shared light sources are, optically coupled to the light-coupling structures of the actuating elements which, for their part, are optically coupled to each other by adjoining light-coupling structures. The light-guiding structures guide the light coupled into the actuating elements to the actuating surface adjacent to the film. The actuating elements may be provided with symbols on their actuating surface adjoining the film, the symbols being visible through the film. Preferably, however, it is the film itself which is provided with symbols and/or legends which are assigned to the actuating elements arranged therebehind. These symbols are then illuminated by the actuating elements.

13 Claims, 1 Drawing Sheet

(56) References Cited

U.S. PATENT DOCUMENTS

| | | | | |
|---|---|---|---|---|
| 2009/0183976 | A1 | 7/2009 | Chang | |
| 2010/0147661 | A1* | 6/2010 | Takeda | 200/314 |

FOREIGN PATENT DOCUMENTS

| | | |
|---|---|---|
| DE | 29514051 | 1/1996 |
| DE | 197 04 253 | 6/1998 |

* cited by examiner

GROUP OF MOMENTARY-CONTACT SWITCHES AS CONTROL PANEL WHICH CAN BE ILLUMINATED IN MOTOR VEHICLES

RELATED APPLICATIONS

This application corresponds to PCT/EP2010/004237, filed Jul. 12, 2010, which claims the benefit of German Application No. 10 2009 036 209.6, filed Aug. 5, 2009, the subject matter, of which we incorporated herein by reference in their entirety.

BACKGROUND OF THE INVENTION

The present invention relates to a pushbutton switch array which is specially suited for use as an operating panel in a motor vehicle.

Switch arrays which are built into a faceplate or a frame and are composed of illuminatable switch units are known. Each switch unit has its own source of illumination. It is also known to use an optical waveguide structure to illuminate a plurality of switch units, the optical waveguide structure distributing the light from a shared light source or few shared light sources to a plurality of switch units. Both solutions are relatively complicated.

SUMMARY OF THE INVENTION

The invention provides a pushbutton switch array having illuminatable switch units which manages with one light source or only few light sources and does not require a separate optical waveguide structure for distributing the light to the various switch units.

The pushbutton switch array according to the invention has a frame which is covered by a transparent film and includes recesses which each have an actuating element accommodated therein for displacement. The actuating elements are configured to have light-guiding and light-coupling structures. A shared light source is, or only few shared light sources are, optically coupled to the light-coupling structures of the actuating elements which, for their part, are optically coupled to each other by adjoining light-coupling structures. The light-guiding structures guide the light coupled into the actuating elements to the actuating surface adjacent to the film. The actuating elements may be provided with symbols on their actuating surface adjoining the film, the symbols being visible through the film. Preferably, however, it is the film itself which is provided with symbols and/or legends which are assigned to the actuating elements arranged therebehind. These symbols are then illuminated by the actuating elements. If the frame also consists of a light-transmissive material, e.g., a plate made from a polycarbonate, the symbols/legends may, if required, be extended laterally beyond the actuating surface located therebehind, so that larger symbols/legends may also be used.

A shared printed circuit board preferably closes the pushbutton switch array on the rear side facing away from the film. Arranged on this printed circuit board are the light sources and assigned switch elements located in opposition to the end faces of the actuating elements facing away from the film.

Advantageous further developments of the invention are specified in the dependent claims.

BRIEF DESCRIPTION OF THE DRAWINGS

Further advantages and features of the invention will become apparent from the description below given with reference to the accompanying drawings, in which.

DESCRIPTION OF AN EXEMPLARY EMBODIMENT

Figure 1:
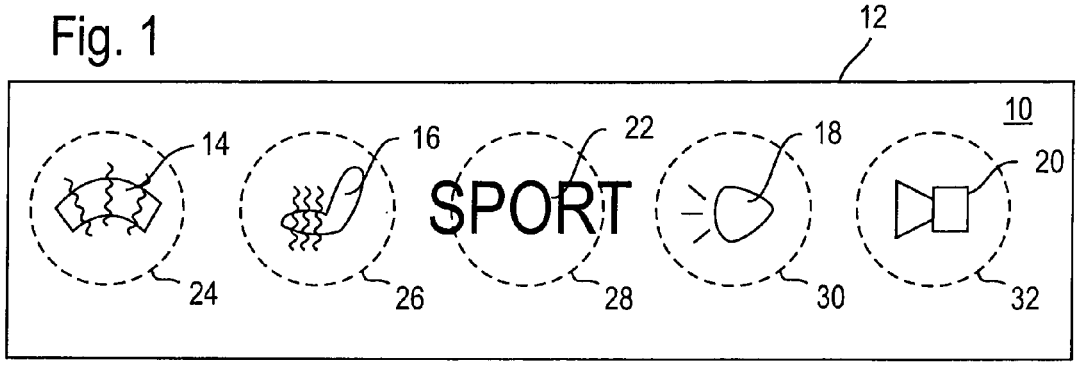
FIG. 1 shows a top view of a pushbutton switch array.
Figure 2:
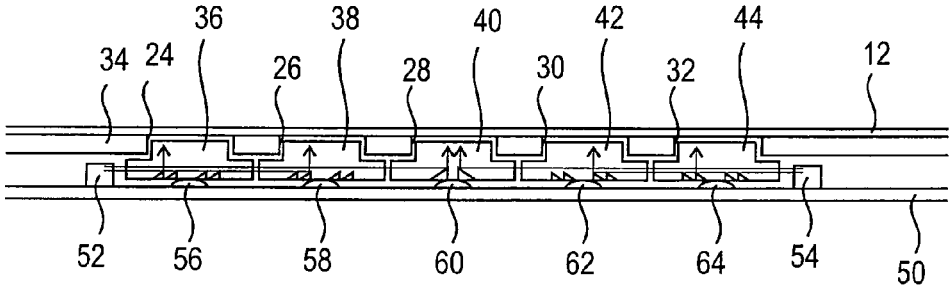
FIG. 2 shows the pushbutton switch array in a schematic sectional view.

FIG. 1 shows a smooth operating panel 10 which is formed by a transparent film 12 (FIG. 2). Four symbols 14, 16, 18, 20 shown by way of example as well as a legend 22 are visible through the film or on the film itself. Round recesses 24, 26, 28, 30, 32 formed in a frame 34 (FIG. 2) under the film are indicated in dashed lines. The frame 34 is formed by a plastic plate made from a transparent material such as a polycarbonate plastic. The recesses 24 to 32 constitute sliding guides for actuating elements 36, 38, 40, 42 and 44 inserted therein which are in the shape of small blocks and consist of a transparent material such as a polycarbonate plastic.

A printed circuit board 50 closes the pushbutton switch array on the rear side facing away from the film 12. In the embodiment shown, the printed circuit board 50 is equipped with two light sources 52, 54 in the form of light-emitting diodes (LEDs) and with switch elements 56, 58, 60, 62, 64, which correspond to the actuating elements 36 to 44.

Depending on the ergonomic demands on the operating panel realized with the pushbutton switch array, the actuating elements may be all of the same design or of different designs.

Figure 3A:
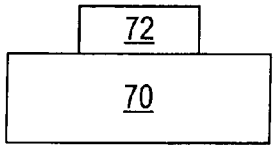
FIG. 3*a* shows a side view of an actuating element.
Figure 3B:
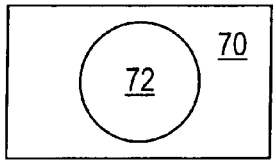
FIG. 3*b* shows a top view of an actuating element.

FIGS. 3*a* and 3*b* schematically show an exemplary embodiment of such an actuating element. The actuating element is a solid body made from a transparent material such as a polycarbonate plastic and consists of a cuboid base body 70 and a cylindrical guide body 72 placed thereon in the middle. Owing to its solid construction from a material having an index of refraction that is greater than that of air, the actuating element as a whole constitutes an optical waveguide. This optical waveguide has optical surfaces laterally on the cuboid base body 70 for coupling light in and out and guides light coupled in into the cylindrical guide body 72; proceeding from there, it shines through the film 12. In the configuration shown in FIG. 2, the two light sources 52 and 54 radiate into the lateral coupling-in surfaces of the outer actuating elements 36 and 44. The light from both light sources is coupled into all of the actuating elements via the lateral, closely adjacent optical surfaces for coupling light in and out and is available to illuminate the respectively associated symbols or legends.

In the embodiment shown, the legend 22, "SPORT", has an extent that goes laterally beyond the boundaries of the recess 28. Nonetheless, this legend is fully illuminated because at the outer edges thereof the shoulder located therebehind of the actuating element base body 70 couples the light into the transparent frame 34.

The invention claimed is:

1. A pushbutton switch array comprising a frame which is covered by a transparent film and includes recesses which each have an actuating element accommodated therein for displacement, the actuating elements being configured to have light-guiding and light-coupling structures, and further comprising a shared light source or few shared light sources which are optically coupled to the light-coupling structures of the actuating elements which, for their part, are optically coupled to each other by adjoining light-coupling structures displaceable relative to each other, the light-guiding structures guiding the light coupled into the actuating elements to the actuating surface adjacent to the film.

2. The pushbutton switch array according to claim 1, further comprising a shared printed circuit board which has the light sources and assigned switch elements arranged thereon that are located in opposition to the end faces of the actuating elements facing away from the film.

3. The pushbutton switch array according to claim 1, in which the actuating elements are made from a transparent plastic material so as to be solid.

4. The pushbutton switch array according to claim 1, in which the actuating surfaces of the actuating elements are provided with symbols.

5. The pushbutton switch array according to claim 1, in which the frame is formed by a plate made from a light-transmissive material.

6. The pushbutton switch array according to claim 5, in which the film is provided with symbols and/or legends which are assigned to the actuating elements.

7. The pushbutton switch array according to claim 6, in which at least one of the symbols and/or legends engages laterally over an associated actuating surface of an actuating element.

8. The pushbutton switch array according to claim 1, for use as an illuminatable operating panel in a motor vehicle.

9. The pushbutton switch array according to claim 1, wherein each of the light-coupling structures has at least one lateral optical surface, the lateral optical surface of a first light-coupling structure optically coupling the first light-coupling structure to a second light-coupling structure.

10. The pushbutton switch array according to claim 9, wherein the at least one lateral optical surface of the first light-coupling structure is displaceable relative to the at least one lateral optical surface of the second light-coupling structure.

11. A pushbutton switch array, comprising:

a frame including a plurality of recesses;

a transparent film covering the frame;

a plurality of actuating elements accommodated within the plurality of recesses of the frame, the actuating elements being displaceable relative to each other, each actuating element including:

a light-guiding structure; and a light-coupling structure optically connecting the plurality of actuating elements to each other; and at least one shared light source optically coupled to the light-coupling structures, the light-coupling structures guiding light emitted from the at least one shared light source into the light-guiding structure and to actuating surfaces adjacent the film.

12. The pushbutton switch array according to claim 11, wherein each of the light-coupling structures has at least one lateral optical surface, the lateral optical surface of a first light-coupling structure optically coupling the first light-coupling structure to a second light-coupling structure.

13. The pushbutton switch array according to claim 12, wherein the at least one lateral optical surface of the first light-coupling structure is displaceable relative to the at least one lateral optical surface of the second light-coupling structure.

* * * * *